United States Patent [19]

Shibukawa et al.

[11] Patent Number: 4,865,786

[45] Date of Patent: Sep. 12, 1989

[54] FOAMED SYNTHETIC FIBER AND ITS MANUFACTURING METHOD

[75] Inventors: Yoshinori Shibukawa, Himeji; Taizo Yasumoto; Muneto Makiyama, both of Kobe; Shouichi Murata; Kazuya Kusunoki, both of Takasago, all of Japan

[73] Assignee: Kanegafuchi Kagaku Kogyo Kabushiki Kaisha, Osaka, Japan

[21] Appl. No.: 82,916

[22] Filed: Aug. 10, 1987

Related U.S. Application Data

[62] Division of Ser. No. 789,287, Oct. 18, 1985.

[30] Foreign Application Priority Data

| | | | |
|---|---|---|---|
| Oct. 19, 1984 | [JP] | Japan | 59-221016 |
| Oct. 19, 1984 | [JP] | Japan | 59-221017 |
| Oct. 19, 1984 | [JP] | Japan | 59-221018 |
| Sep. 28, 1985 | [JP] | Japan | 60-215985 |

[51] Int. Cl.[4] ..... B29D 00/00

[52] U.S. Cl. ..... 264/51

[58] Field of Search ..... 264/51, 53, 45.5, 41

[56] References Cited

U.S. PATENT DOCUMENTS

| | | | |
|---|---|---|---|
| 3,322,611 | 5/1967 | Stevenson | 428/398 |
| 3,411,979 | 11/1968 | Lewis, Jr. | 428/398 |
| 3,424,645 | 1/1969 | Ohsol | 428/398 X |
| 3,957,936 | 5/1976 | Lauchenauer | 428/398 X |
| 3,984,515 | 10/1976 | Mommaerts et al. | 428/398 X |
| 4,212,915 | 7/1980 | Vollbrecht et al. | 428/288 |
| 4,347,203 | 8/1982 | Mimura et al. | 428/398 |
| 4,515,859 | 5/1985 | De Maria et al. | 428/398 |
| 4,544,594 | 10/1985 | Li et al. | 428/398 X |

FOREIGN PATENT DOCUMENTS

| | | |
|---|---|---|
| 40-21485 | 9/1965 | Japan . |
| 41-6294 | 4/1966 | Japan . |

*Primary Examiner*—Philip Anderson

*Attorney, Agent, or Firm*—Sughrue, Mion, Zinn, Macpeak & Seas

[57] ABSTRACT

Disclosed is a foamed synthetic fiber characterized in that an organic solvent solution of a thermoplastic polymer admixed with 3–100 weight percent of a compound scarcely soluble or insoluble in the aqueous coagulating bath for wet spinning, which is liquid under normal pressure and has a boiling point of 120° C. or less, as foaming agent is injected as spinning dope into said aqueous coagulating bath and it is foamed in a drying atmosphere at the boiling point or more of the foaming agent and 100° C. or more and has an expansion ratio of 3 percent or more, and the manufacturing method thereof. The foamed synthetic fiber of the present invention is light and bulky, being excellent in warmth-keeping and heat-insulating performance with its appearance, touch and development of color similar to those of an animal hair.

8 Claims, 4 Drawing Sheets

FOAMED SYNTHETIC FIBER AND ITS MANUFACTURING METHOD

This is a division of application Ser. No. 789,287 filed 10/18/85.

BACKGROUND OF THE INVENTION

1. Field of the Invention

The present invention relates to a foamed synthetic fiber and its manufacturing method and more particularly to a novel and useful fiber which, provided with the known features of foamed fiber, has its most serious defect of low strength improved and also feature its improved feeling and development of color like animal hairs.

2. Description of the Prior Art

Besides the so-called essential improvement of fiber and its functions through designing of new textile composition and impartation of textile properties, various measures have been taken in recent years for improvement of their added values through contrivance of the fiber's three-dimensional structure. So, among others, effort has been made for further subdivision of the so-called islands type of fiber's cross-section such as seen in animal hairs, and reforming attempts have been made through adoption of profile cross-sections and further improvement of the fiber's fine surface. The foamed fiber belongs to the latter category and various attempts have been made for forming inside the fiber isolated or mutually continuous bubbles or a combination thereof for improved lightweight feature, bulkiness, soft touch, elasticity etc.

As typical examples are cited in Japanese Patent Publication No. 4536/68, Japanese Patent Publication No. 850/71 and Japanese Laid Open Patent Application No. 36208/83. These, however, invariably deal with synthetic rush and industrial materials or interior decoration materials, not dealing with the so-called general fibers including those for clothing. Worse, the materials proposed with their construction lack in mechanical properties required for spinning, weaving and knitting etc. ordinary fibers are to undergo, in mechanical strength and elongation in particular, and still more serious is their poor dyeability (behavior in dope dyeing, dyeing or printing), the colored products badly lacking in gloss and transparency. Meanwhile, Japanese Patent Publication No. 21300/67, Japanese Patent Publication No. 210/76, Japanese Patent Publication No. 38527/83 etc. are supposed to be intended for use in this field, but the fiber constructions proposed in these inventions have only a few bubbles per fiber cross-section, thus being insufficient for the feature of foamed fiber to be fully exhibited.

Further, Japanese Laid Open Patent Application No. 77616/75 discloses a conjugated fiber but it can hardly be economically advantageous for (1) sheath and core cannot be made of the same composition;

(2) more than one kind of dope are required; and (3) complicated equipment is required for its manufacture because of, among others, compound nozzle required; and (4) the performance is largely different from what is aimed at by the present invention.

SUMMARY OF THE INVENTION

It is a principal object of the present invention to provide a textile product with its lightweight, bulkiness, warmth-keeping and heat insulating features and improved in lightweight-induced economical feature.

Another object of the present invention is to provide a fiber similar to animal hair in appearance, touch and development of color.

These and further objects and advantages will be apparent from the following description.

The present invention has been completed as a result of earnest study to achieve the above-mentioned objects. Through formation of bubbles inside thermoplastic fiber at a given expansion ratio and, more preferably, through provision of a given major/minor axis ratio for the fiber's cross-section, the present inventors have succeeded in elimination of the above-mentioned defects of the conventional foamed fiber, in imparting the fiber with still better touch and dyeability (special color effect) and further in imparting the fiber with appearance and touch closely similar to an animal hair.

DETAILED DESCRIPTION OF THE INVENTION

Figure 1:
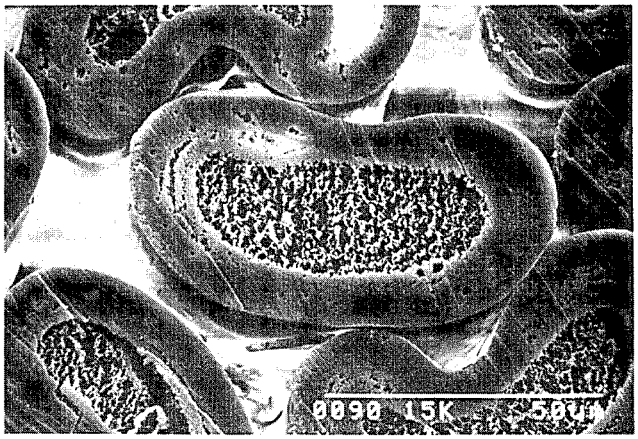
FIG. 1 is a scanning electron microscopic picture showing the cross-section of a fiber obtained in Example 1 of the present invention.

Firstly, the polymer constituting the fiber of the present invention may be any thermoplastic polymer such as vinyl polymers represented by acrylonitrile, polyvinyl chloride and vinylidene chloride, olefin polymers, and other polymers of polyamide, polyester and polyurethane types. As foaming polymer are cited vinyl polymers, of which preferred are polymers containing acrylonitrile which preferably contains more than 25 weight % acrylonitrile, still more preferably 35–85 weight % and most preferably 40–60 weight % of acrylonitrile. These are naturally usable as straight polymers, copolymers or even polymer blends.

Secondly, described below is the basic concept with regard to spinning method by the use of a low-boiling point compound. Usually in order to obtain a foamed fiber by the use of a low-boiling point compound, a liquid low-boiling point compound (hereinafter called "foaming agent") is added under normal pressure to a solvent solution of a thermoplastic polymer before it is supplied to the spinning nozzle to prepare a spinning dope. After spinning or injection into the coagulating bath, the foaming agent contained in the fiber is heated to a temperature higher than its boiling point in the step of fiber formation and the resulting gas' expansion force is used for obtaining the aforesaid fiber composition (bubble formation). There is no further point of difference with regard to drawing; heat treatment etc. The explanation below follows the order in this basic method.

For spinning may be used any of the conventional wet spinning process. If necessary the semi-dry wet process as revealed in Japanese Laid Open Patent Application No. 30934/79 may as well be used.

The foaming agent is preferred to be one readily vaporizable in a range of temperature encountered in normal spinning process, being liquid under normal pressure, and its boiling temperature is required to be not more than 120° C., preferably in a range of 10°-100° C. As such foaming agent are cited, among others, lower aliphatic hydrocarbons such as pentane, hexane, heptane and petroleum ether, lower alicyclic hydrocarbons such as cyclopentane and cyclohexane, alcohols such as methanol and ethanol, halogenized hydrocarbons such as ethyl bromide, methyl iodide and methylene chloride, ethers such as diethylether, chlorofluorohydrocarbons such as 1,1,2-trichloro-1,2,2-trifluoroethane, and trichloromonofluromethane, ketones, aldehydes, esters, etc. These foaming agents are added to polymer's solvent solution i.e. spinning dope. When solvent is used, its kind has to be very carefully selected as well as the kind of foaming agent. It is not too much to say that the elaborate choice thereof led use to the present invention. According to a conventional method, e.g. an existing patent pertaining to acrylic foamed fiber, it is an essential requirement that the foaming agent be non-solvent for the polymer, be insoluble or scarcely soluble in the polymer's solvent solution or the coagulating liquor. As such examples there are inorganic solvents such as nitric acid and sodium thiocyanate as quoted in Japanese Patent Publication No. 210/76 and Japanese Patent Publication No. 38527/83, polar organic solvents such as dimethyl formamide (DMF), dimethylsulfoxide (DMSO) and dimethyl acetoamide (DMA) as quoted in Japanese Patent Publication Nos. 6297/66 and 21300/67. By these methods, however, the foaming agents are invariably merely dispersed in the solution and in such a state there is a risk of cohesion of the foaming agent in the piping leading to the spinning nozzle, clogging of the spinning nozzle especially in the case of flat fiber, breakage of fiber, lowering of foaming efficiency, lowering of the strength of the foamed fiber, these often being of serious consequences. According to the present invention, the foaming agent is required to be non-solvent for the polymer, soluble in the solvent for the polymer or polymer's solution, and insoluble or scarcely soluble in the coagulating liquor or water in the case of wet spinning process. The reason for the required non-solvency in the polymer is that an interface against the polymer is essential for the foamed composition attained by the expansion force of the gas resulting from vaporization of the foaming agent. That the foaming agent is required to be soluble in the solvent for the polymer as well as the polymer's solution is for prevention of influences of the aforesaid dispersion and also for forming to take place throughout the fiber interior. In the wet spinning process the foaming agent is required to be insoluble or scarcely soluble in the coagulating bath or water for it is naturally desired to be highly effective with the escape of the foaming agent from the system minimized. According to the above definition, the solvent-foaming agent combination may be 1,1,2-trichloro-1,2,2-trifluoroethane for DMF and 1,1,2-trichloro-1,2,2-trifluoroethane, pentane, hexane etc. for acetone. The spinning dope is pressed out of the spinning nozzle into a coagulating bath (water, solvent or heated gas), where a series of fiber forming steps of so-called coagulation go on such as diffusion of solvent from the surface beyond the fiber's sphere, coagulating bath in the case of the wet process, where ingress of water and the resultant drop of solvent concentration with respect to polymer, isolation or precipitation of polymer will result. This coagulating process goes on repeating a cycle of diffusion from the fiber's surface of solvent to beyond its sphere and of ingress of coagulating liquor into the fiber interior gradually from the fiber surface toward its interior, and is formed in time the so-called uncoagulated elastic fiber. In the fiber's surface closest to the coagulated phase is then formed a sheath-like hull called generally "skin layer."

This skin layer acts preventing rapid coagulation of the fiber interior and also preventing dissolving out of the foaming agent beyond the fiber's boundary. This layer also prevents foaming in the fiber's surface. Meanwhile, since the foaming agent is non-solvent for the polymer, it is dissolved in the solvent in the spinning dope, hence in the coagulating process shows a diffusion behavior similar to the solvent. Since, however, it is insoluble or scarcely soluble in the coagulating bath or water, it does not or scarcely dissolve out of the fiber and at least the greater part of the foaming agent remains inside the fiber in the state of a stabilized mixture with solvent. Comparison shows that in the conventional process the solvent and the foaming agent show entirely different behaviors. The foaming agent in particular, which has been dispersed in the spinning dope, is further isolated from the polymer and solvent with the consequence that it is singly and irregularly isolated in the fiber in general or coheres to show clear phase separation to trigger local foaming in the subsequent heat treatment.

The dose of the foaming agent ranges from 3 to 100 weight %, and more preferably 5-50 weight %, although it depends on the kind of foaming agent and its solvency in thermoplastic polymer solution. The proper dose is arbitrarily selectable according to the state of fiber formation after spinning and the fiber's cross-section besides the aforesaid kind of foaming agent and the state of spinning dope after addition of the foaming agent. As the method of addition of foaming agent may be adopted a system in which the foaming agent is added alone or in combination with organic solvent directly into the spinning dope tank or mixed in the dope immediately before spinning through the nozzle.

If necessary, judging from the fiber's state of foaming or for manufacture-related reasons, the nucleus-forming agent may be added to the spinning dope.

As nucleus-forming agent may be used inorganic powder up to 10 μm in average particle size, preferably 5 μm or less and still more preferably 2 μm or less, and as such inorganic compounds may be used, for instance, nonmetallic oxides such as boron oxide, silicium oxide, metal oxides such as aluminum oxide, antimony oxide, zirconium oxide, titanium oxide, zinc oxide and tin oxide, scarcely water-soluble or insoluble metal hydroxide or metal salts, silicium compounds such as kaoline, talc and bentonite, but this does not mean limitation and more than one of the above may be used in combination. Further, as organic nucleus-forming agents are known cellulose esters such as cellulose acetate, cellulose propionate and cellulose lactate, which may be used also in combination with inorganic particles. There is no particular limitation with regard to the dose of such nucleus-forming agents.

As the effect of such nucleus-forming agents are known prevention of local foaming in the process of forming fiber for improved stability of manufacturing process and reduced risk of fiber breakage due to local foaming. Besides the above-mentioned effect, cellulose ester is effective in improving the combing behavior of foamed fiber when it is used in the manufacture of piled fabric.

The spinning dope so prepared is then pressed out into the coagulating bath by the semi-dry or wet spinning process for the foamed fiber to be formed. Other additives for imparting to the formed fiber necessary properties for special uses such as stabilizers, organic or inorganic colorants, optical whiteners, delustering agents and flame retardant agents may be used if they do not interfere with the object of the present invention.

As to the spinning method, the prepared spinning dope is to be pressed out through the spinning nozzle into the aqueous coagulating bath. As the spinning nozzle there are many alternatives in slit form such as circular, rectangular and other profiles, of which any one may be chosen according to the intended use for the particular fiber. As coagulating bath may preferably be used one of aqueous solution of an organic solvent for the polymer, and the temperature and concentration may be arbitrarily set within the foaming agent's boiling point with the coagulating condition, the solubility of the foaming agent used in the coagulating bath and the cross-sectional shape of the fiber to be manufactured taken into due consideration. By "taking into consideration the solubility of the foaming agent used" is meant that the foaming agent is required to be scarcely be soluble or insoluble in the aqueous solution of organic solvent. Concretely, the solubility of foaming agent in coagulating bath should be to 10 weight % and preferably up to 5 weight %. If the solubility of the foaming agent used in the coagulating bath should exceed 10 weight %, the concentration of the foaming agent in the polymer is reduced markedly to result in insufficient foaming in the later foaming process. If the coagulating bath temperature should exceed the foaming agent's boiling point, the fiber begins foaming but the foamed fiber has its bubbles crushed or welded, this resulting in a foaming fault.

The fiber of the coagulated polymer is, if necessary, drawn in the bath of aqueous solution of the organic solvent for the polymer or in air before it is rinsed in water bath. The rinsing temperature may be arbitrarily set regardless of the foaming agent's boiling point, but for smooth forming of fiber, it is advisable to remove the solvent for the polymer from the fiber with the foaming agent remaining in the fiber, and for enhancing desolvation it is advisable to keep the rinsing temperature high. If necessary, drawing may be carried out in the rinsing process. It is also possible to attain partial foaming with the rinsing temperature higher than the temperature of the foaming agent. Too rapid foaming in the rinsing process is, however, problematic with regard to fiber formation, hence it is advisable to set the rinsing temperature with the kind of the foaming agent used and desolvation from fiber taken into due consideration.

When as in the conventional method a foaming agent insoluble in the solvent is used, it is extremely difficult to realize the mixed state of the present invention. Hence the fiber structure attainable is the so-called scattering giant bubbles caused by local foaming due to isolated cohesion of the foaming agent in the polymer. It is not too much to say that the fiber's final foaming condition is determined by the properties and distribution of the foaming agent and the solvent in the fiber interior and their behavior in the later heating process.

The resulting foamed fiber is treated with lubricant and dried for further enhancement of fiber formation. If the solvent for the polymer should exist in the rinsing bath before the drying process more than a certain limit, it results in welding between fibers to cause decrease of "degree of opening," hence it is advisable to treat the fiber with a proper lubricant having antistatic effect so as to minimize the risk of electrostatic disorder. When the dose of foaming agent is high, the solvent content of the spun and rinsed fiber is inevitably high, this resulting in an increased risk of welding of single fibers. To prevent it, it is advisable to use a lubricant of high release effect, particularly good in this respect being silicone lubricant. As silicone lubricants are usually used dimethylpolysiloxane, methylhydrogen polysiloxane and alkoxypolysiloxane as well as denatured polysiloxane such as epoxy group-containing polysiloxane and amino group-containing polysiloxane, these being used generally in emulsion form. Particularly preferred is the use of epoxy group denatured or amino group denatured silicone lubricant for improving the touch of foamed fiber.

Then, the drying process has to be conducted under the drying atmosphere of more than the foaming agent's boiling point and not less than 100° C. If the drying temperature is below 100° C., the fiber remains wet inside, this interfering with physical properties of the fiber and also causing trouble in the later fiber processing step. If the fiber's temperature should fail to reach the boiling point during rinsing or drying, there will result in insufficient foaming which is, needless to say, undesirable.

The fiber having passed the coagulating and heating (foaming) process undergoes the required steps of processing namely primary drawing, rinsing, drying, secondary drawing, heat treatment and crimping before it comes to be the final finished fiber, but these steps may be basically the same as with ordinary fiber. It is also possible to do heating (foaming) simultaneously with coagulation, primary drawing, rinsing etc. The use of various auxiliaries for improving the fiber's spinning property, anti-static, water or oil repellent properties, soil release property, touch etc. has nothing to do with the present invention and any thereof may be used as necessary. The same can be said about dyeing, printing, coating, laminating, shaping finish etc.

The spongy foamed portion of the present invention means independent or mutually continuous bubbles or mixture thereof are random-dispersed inside the fiber or polymer composition. The bubbles may as well be blocked by the film-like formation, structure simulating yeast fermentation in bakery or islands formation. Needless to say, however, these bubbles are required to be not interfering with the essential point of the present invention, i.e. effect based on the foamed structure. In this respect, bubbles reaching the fiber surface, which means cracks or craters adversely affecting the fiber's dyeability (special color effect) or spinnability, are to be strictly avoided.

The expansion ratio is desired to be 3% or more. If it is less than 3% no sufficient performance as foamed fiber can be hoped for, while if it is more than 100%, it is not practical either interfering with the fiber's mechanical or physical properties. A preferred range is 5–90% in which the object of the invention can be achieved effectively. Evaluation can be made more strict and exacting if physical properties, apparent thickness when the fiber is dyed especially in deep or pale shades, delicate lustre and impression of transparency etc. are added to criteria.

The foamed fiber whose cross-section has clearly defined the bubbled core where there are a multiplicity of bubbles in a sponge-like formation and the sheath layer of the construction clearly distinguishable from the former (hereinafter called "double layer foamed fiber") is further improved in the bulkiness, warmth-keeping property, mechanical and physical properties and development of color like animal hairs.

The bubbled core formed by partition walls in a sponge-like formation of the present invention is a portion enclosed by the sheath layer not substantially including bubbles as described below, which represents a multiplicity of independent or continuous bubbles dispersed at random, a bubble formation with a hollow space inside subdivided by film-like walls, a yeast fermentation composition or islands' formation around the center of the cross-section. The core's position is, however, not limited if it is only surrounded by the sheath layer.

Figure 6A:
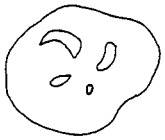
FIG. 6A, B and C are sketches showing the cross-sectional shapes of conventional foamed fibers.
Figure 6B:
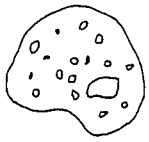
Figure 6C:
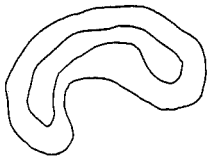

The sheath distinguishable from the bubbled core means a portion whose compactness is similar to that of non-foamed fiber, but it is not required to be entirely free from bubble formation. It suffices if the portion has a compactness different from that of the bubbled core. Needless to say, however, it should not interfere with the effect of double layer structure which is the essential point of the present invention. The above foamed structure is different from that of ordinary hollow fiber, which has its cross-section subject to deformation due to heating or application of external mechanical force and provides no effect comparable with the present invention. Those with a few bubbles in the cross-section or with bubbles distributed in the entire cross-section so that the sheath layer is not distinguishable are not in the scope of the present invention. FIG. 6 is given to show the typical cross-section of the conventional counterparts. FIG. 6(*a*) is an example of fiber formed by the use of a chemical foaming agent, FIG. 6(*b*) is an example of phase separation induced by means of blending incompatible polymer, and FIG. 6(*c*) is a foamed fiber with its interior hollow manufactured by the use of a low-boiling point foaming agent.

Figure 7:
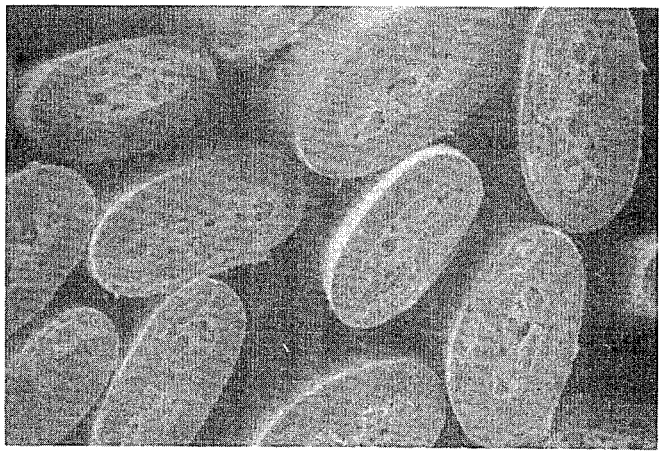
FIG. 7 and 8 are microscopic pictures showing the cross-sections of animal hairs quoted in the text as references.
Figure 8:
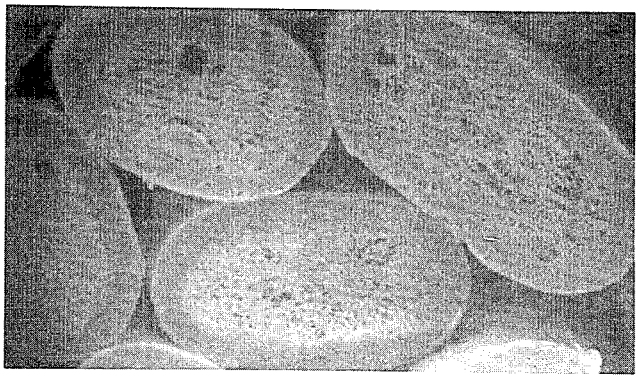

The double layer structure of the present invention can be appreciated against the cross-sectional structures of natural animal hairs shown in FIG. 7 and FIG. 8 in terms of the proportion of the bubbled core in area to the total cross-section. The foamed core/cross-section proportion in area, which is calculated by the formula described below, may preferably be between 5 and 90%. If it is less than 5% no sufficient performance as foamed fiber can be hoped for, while if it is more than 90%, it is not practical either interfering with the fiber's mechanical or physical properties. A still more preferred range is 10–60% in which the object of the invention can be achieved effectively. Evaluation can be made more strict and exacting if physical properties, apparent thickness when the fiber is dyed especially in deep or pale shades, delicate lustre and impression of transparency etc. are added to criteria.

There is no limitation with regard to the basic cross-sectional form of the foamed fiber of the present invention and it may be any one of a large variety including circular, U-shaped, eyebrow shaped, potato shaped, rectangular, triangular, Y-shaped, +-shaped and star shaped.

Of the above, cited here is one whose cross-section is rectangular (hereinafter referred to as "flat"). Adoption of "flat" or slit-shaped cross-section of foamed fiber is a usual practice in the trade for it imparts to the fiber a very soft touch for its apparent thickness and brings about quite an interesting color effect due to its increased reflection area and orientation etc. As seen from the microscopic cross-sectional pictures of FIG. 7 (natural mink) and FIG. 8 (natural fox), the animal hair has flat bubbles, which, however, are neither simple nor uniform, presenting a sponge-like appearance with its hollow space inside partitioned by a multiplicity of film-like walls. The present inventors recognized that this difference in structure was a cause for the great difference in performance between the two, i.e. animal hair and conventional foamed fiber, this being a very important point for improving the value of "flat fiber."

The basic cross-sectional shape is here not limited to rectangular, but it may as well be "dog bone"-shaped, oval-shaped, dumbbell shaped, rhombic shaped, sweet potato shaped, or even circular.

As to the basic structure of the present invention, the cross-sectional shape of an animal hair in FIG. 7 or FIG. 8 may be taken as control represented by the major/minor axis ratio and expansion ratio determined through measurement of the fiber's specific gravity. This expansion ratio is closely related with the fiber's sponge-like structure. The major/minor axis ratio is preferably between 2.0 and 15.0, the desired thick impression being not attainable when it is less than 2.0.

The foamed fiber thus obtained is, needless to say, has the characteristics of ordinary fiber and, in addition thereto, a number of outstanding features accounted for by its foamed structure, namely light-weight feature, bulkiness, warmth-keeping and heat insulation features. The greatest feature of the double layer structure is upkeeping of mechanical strength of the foamed fiber, and this kind of foamed fiber can well withstand advanced processings such as dyeing, spinning, knitting and weaving. Further to be pointed out are its soft touch and excellent dyeability (special color effect). Moreover, surprisingly, the foamed fiber of the present invention is closely similar to natural animal hair in gloss, touch and development of color. as will be further described later.

The features of natural animal hair become more apparent when they are colored with their own pigments or dyed. When natural animal hairs are closely examined, it is seen that the so-called "guard hairs" have their apparent thickness largely dependent upon the depth of their shades.

That is, while they appear to be thick and matt when they are in pale shades such as beige or grey, they appear to be extremely thin, transparent and presenting gloss when they are in deep shades such as brown or black. Furthermore, the depth of shade varies even with individual hairs continuously, this presenting quite an interesting effect. The present inventors assumed that the cause therefor lies in the optical properties of the core portion of animal hair, and reached the following conclusion after further study. Although the reason still remains unknown, the inventors are of the opinion that the above is attributable to the multiple reflection and scattering of the light incident upon the sponge structure. When the hair is pale-colored, the greater part of the incident light is subjected to multiple reflection in the spongy core and presents a matt appearance similar to the case of addition of an apparent inorganic (filler) etc. When it is dark-colored on the other hand, the incident light is absorbed by the colorant which is amply present and the above effect in the spongy core is offset, the result being no visible effect.

Thus, the depth of color delicately influences the apparent thickness of animal hair.

Looking at the double layer foamed fiber when it is pale-colored, the incident light transmits the sheath portion almost straight to reach the sheath/core boundary for the fiber then contains a small amount of colorant and high in transparency. There, however, part of the incident light is reflected irregularly while the rest is subjected to multiple reflection to give a matt effect similar to the case of addition of an apparent inorganic (filler). When the fiber is deep-colored, the incident light is for the most absorbed by the colorant which is amply present and these phenomena at the boundary have no visual effects. Since the sheath portion is compact by nature, the gloss of the fiber surface gives a fascinating impression when it is combined with the so-called "mirror effect" of the sheath/core boundary.

The unique touch of the fiber of the present invention is supposed to be attributable to the apparent thickness for the flat cross-section of the fiber (area effect of the major-axis side), soft touch feature (bending effect on the minor-axis side) and the spongy structure with its high resiliency. Moreover, when the spongy core itself is assumed to be a multiple layer, it is possible that pearl-effect lustre is produced like when a pigment in flake form is used, this presumably be another reason for the "fascinating effect."

Hereafter examples are given for concrete explanation of the present invention, but these are mere examples and the present invention is by no means limited thereby or thereto.

The area ratio, major/minor axis ratio, apparent density and expansion ratio referred to in the text or Examples were determined by the following methods. (a) Area ratio Using scanning-type electron microscope (Hitachi Works' Model S-510), the cross-section of a single fiber was photographed from right above at a fixed magnification factor and at fixed distance and, after confirmation of the sheath/core structure, the total cross-sectional area was determined. Then the cross-sectional are of the sheath portion is determined and the proportion of the core portion to the total cross-sectional area was calculated by the following formula as average of 25 specimens.

$$\text{Area ratio } (\%) = [(Ss - Sb)/Ss] \times 100$$

where:

Ss: Total cross-section of foamed fiber

Sb: Total cross-section of sheath portion of the foamed fiber (b) Major/minor axis ratio Using scanning-type electron microscope (Hitachi Works' Model S-510), the cross-section of a single fiber was photographed from right above at a fixed magnification factor and at fixed distance. 25 specimens were then taken at random, their major and minor axes were measured, the major/minor axis ratio was determined with each specimen and average was taken.

Major/minor axis ratio = length of major axis/length of minor axis (c) Expansion ratio Approximately 0.5 g of specimen (sliver) was precision weighed in the air, dipped in the upper & lower water vessels of an automatic densitometer (Toyo Seiki Seisakusho, Ltd.) at a speed not exceeding the fiber's wetting speed and the fiber's specific gravity was measured by the amount of the water displaced. In order to prevent formation of air bubbles on the surface of the specimen in water a fluorine surfactant was added in a trace amount as bubble-arrestor. Then, the expansion ratio was calculated from the specific gravity by the following formula.

$$\text{Expansion factor } (\%) = (B/S - 1) \times 100$$

where:

B: Specific gravity of non-foamed fiber (blank)

S: Specific gravity of foamed fiber

EXAMPLE 1

A copolymer composed of 50 weight % of acrylonitrile, 49 weight % of vinyl chloride and 1 weight % of sodium styrenesulfonate was dissolved in acetone, 40% of 1,1,2-trichloro-1,2,2-trifluoroethane and 0.2% of titanium dioxide were added per unit weight of polymer, the concentration of the polymer was adjusted to be 25 weight % and stirred at 40° C. for 30 minutes in a closed container.

The resulting spinning dope was injected into a bath of 21% aqueous solution of acetone at 25° C. through a nozzle plate 0.18 mm hole diameter × 200 holes and dipped in the bath for 9 seconds at a winding speed of 4.5 m/min. Then, the fiber was dipped for 6 seconds in the bath of the same composition and temperature being drawn 1.8-fold and thereafter was allowed to dwell in a hot water bath of 75° C. for approximately 1 minute under tension for foaming to be completed. The resulting rinsed fiber was dried in a hot flue dryer of 120° C. to a residual water content of 1% maximum, this followed by the secondary drawing of 2.75-fold and heat treatment under tension at 145° C. for 5 minutes, and thus was obtained a foamed fiber 15 denier in single fiber fineness, 43% in area ratio, 0.86 in apparent density and 50% in expansion ratio. When this fiber was finished in the usual way as a high-pile fabric, it was entirely different from the conventional artificial fur, being extremely light and its shade, gloss and touch being rich and elegant. The scanning electron microscopic picture of the cross-section of the fiber obtained is shown in FIG. 1.

EXAMPLE 2

Figure 2:
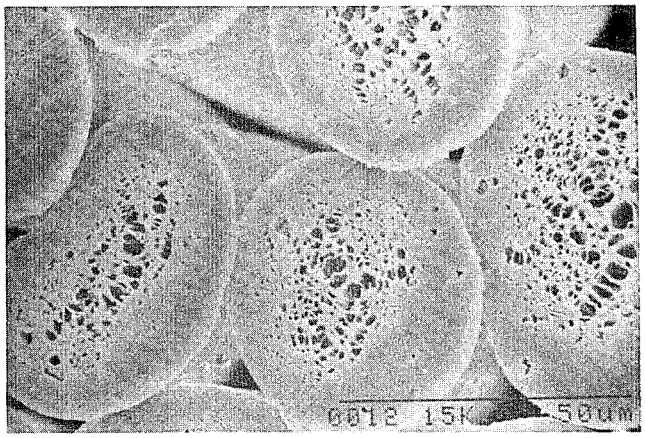
FIG. 2 is a like picture relating to Example 2 of the present invention.

Polymer of the same composition as in Example 1 was dissolved in acetone, 20% of n-pentane and 2% of calcium carbonate powder were added per unit weight of the polymer, the final concentration of the polymer was adjusted to be 25 weight % and stirred at 33° C. for 30 minutes in a closed container. The resulting spinning dope was injected into a bath of 50% aqueous solution of acetone at 10° C. through the same nozzle plate and dipped in the bath for 9 seconds at a winding speed of 4.5 m/min. Then, the fiber was dipped for 18 seconds in a bath of 40% aqueous solution of acetone being drawn 3.06-fold and thereafter primary foaming was carried out continuously for 12 seconds in a water bath of 50° C. Then the fiber was allowed to dwell for 13 seconds in hot water of 70° C. for foaming to be completed. The rinsed fiber was dried in a hot flue dryer of 120° C. to a residual water content of 1% maximum, this followed by the secondary drawing of 2.65-fold and heat treatment under tension at 145° C. for 5 minutes, and thus was obtained a foamed fiber 15 denier in single fiber fineness, 16% in area ratio, 0.95 in apparent density and 35.8% in expansion ratio. When this fiber was used for making Wilton carpet, it was bulky and body-rich and it had its shade in the fiber's cross-section and side varying delicately and attractively. The scanning electron microscopic picture of the cross-section of the fiber obtained is shown in FIG. 2.

EXAMPLE 3

Figure 3:
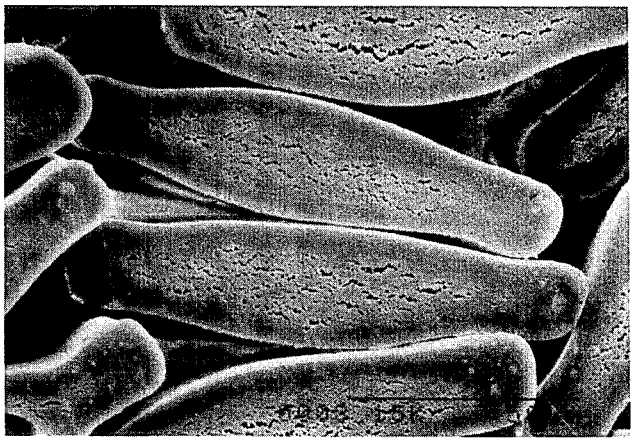
FIG. 3 is another like picture relating to Example 3 of the present invention.

The same spinning dope as in Example 1 was injected into a 25° C. bath of 30% aqueous solution of acetone through a nozzle plate having 100 rectangular slits 0.60 mm in major axis and 0.08 mm in minor axis and the resulting fiber was allowed to be dipped in the bath for 9 seconds being wound up at a speed of 4.5 m/min. Then, the fiber was dipped for 6 seconds in a bath 25% aqueous solution of acetone 30° C. being drawn 1.8-fold and thereafter was allowed to dwell in a hot water bath of 75° C. for approximately 1 minute under tension for foaming to be completed. The resulting rinsed fiber was dried in a hot flue dryer of 120° C. to a residual water content of 1% maximum, this followed by the secondary drawing of 2.75-fold and heat treatment under tension at 145° C. for 5 minutes, and thus was obtained a flat foamed fiber 20 denier in single fiber fineness, 4.5 in major/minor axis ratio and 15% in expansion ratio. When this fiber was finished in the usual way as a high-pile fabric, it was entirely different from the conventional artificial fur, being extremely light and its shade, gloss and feeling being rich and elegant. The scanning electron microscopic picture of the cross-section of the fiber obtained is shown in FIG. 3.

EXAMPLE 4

12% of n-pantane and 2% of calcium carbonate powder were added to the same polymer as in Example 1 and a spinning dope of 25% polymer was obtained. This dope was injected into a 25° C. bath of 21% aqueous solution of acetone through a nozzle plate having 100 oval slits 0.55 mm in major axis and 0.13 mm in minor axis and the resulting fiber was allowed to be dipped in the bath for 9 seconds being wound up at a speed of 4.5 m/min. Then, the fiber was allowed to dwell in a bath of the same composition and temperature for 18 seconds being draw 1.8-fold and thereafter was allowed to dwell in a hot water bath of 75° C. for 45 seconds under tension for foaming to be completed.

Figure 4:
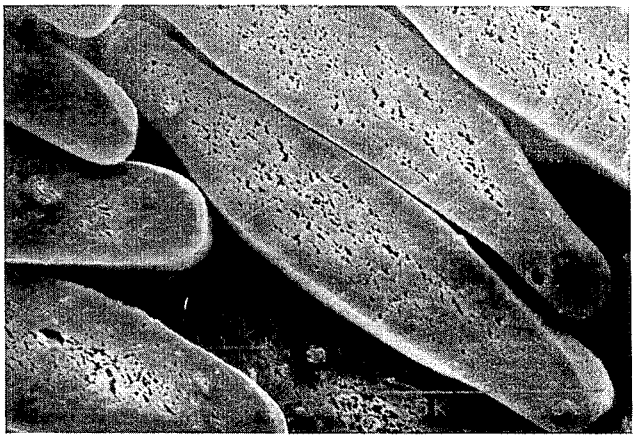
FIG. 4 is a still another like picture relating to Example 4 of the present invention.

The resulting fiber was processed in the same way as described above in Example 3 and was thereby obtained an oval-sectioned fiber 15 denier in single fiber fineness, 5.4 in major/minor axis ratio and 12% in expansion ratio. When this fiber was finished in the usual way as a high-pile fabric, it proved to be excellent as mentioned above in Example 3. The scanning electron microscopic picture of the cross-section of the fiber obtained is shown in FIG. 4.

CONTROL EXAMPLE 1

Figure 5:
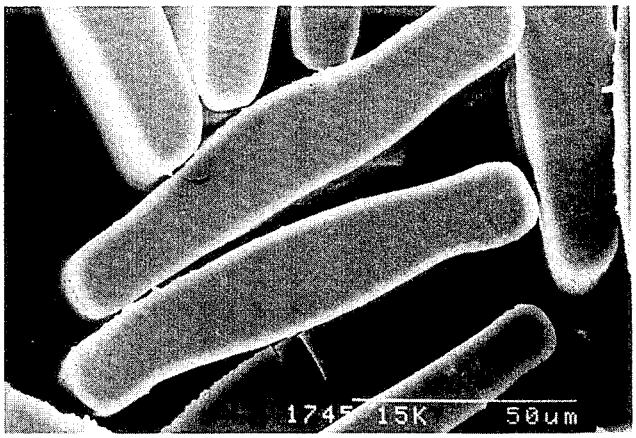
FIG. 5 is a microscopic picture showing the cross-section of a conventional fiber quoted as Control Example 1.

A flat fiber (conventional one) 20 denier in fiber fineness and 6.3 in major/minor axis ratio was obtained in the same way as described above in Example 4 except the use of foaming agent and nucleus-forming agent. Its scanning electron microscopic picture is shown in FIG. 5.

EXAMPLE 5

(1) A copolymer of 48 weight % of acrylonitrile, 51 weight % of vinyl chloride and 1% of sodium p-styrenesulfonic acid was dissolved in acetone (dope A), 40% of 1,1,2-trichloro-1,2,2-trifluoroethane, 0.2% of titanium dioxide and 2% of polyglycidyl methacrylate were added per unit weight of the polymer, the concentration of the polymer was adjusted to be 22.7 weight % and stirred at 45° C. for 3 hours to prepare a spinning dope. This spinning dope was injected into the first bath of 20% aqueous solution of acetone at 25° C. through a nozzle plate having 10,000 holes of 0.15 mm in hole diameter, the resulting fiber was drawn 1.2-fold in the second bath of the same temperature and concentration, rinsed in the third bath (65° C.), fourth bath (75° C.) and fifth bath (80° C.) while being drawn a total of 2.1-fold, and the fiber was then dipped in a bath containing nonionic antistatic agent and amino group-denatured polysiloxane emulsion to pick up these auxiliaries. The fiber was then dried at 110° C., drawn in an atmosphere of 130° C. at a draft ratio of 1:2.5, then under a heat treatment condition of 145° C. at a reduced draft ratio of 1:0.9 for the foamed fiber of 7 d to be prepared, and the fiber was then crimped by the use of Staffer type crimper and cut to a length of 51 mm. (Staple fiber A)

(2) To the polymer of Dope A 45% of 1,1,2-trichloro-1,2,2-trifluoroethane, 0.2% of titanium dioxide and 2% of polyglycidyl methacrylate were added and the final concentration of the polymer was adjusted to be 22.5 weight %. Then the dope so prepared was injected through a nozzle plate having 13333 holes 0.11 mm in diameter into the first bath of 20% aqueous solution of acetone 23° C. Then the fiber was drawn 1.2-fold in the second bath of the same temperature and concentration, and through the third rinsing bath 80° C. and fourth rinsing bath 84° C. the fiber was further drawn 2.1-fold. Thereafter the fiber was finished in the same way as described above (Staple fiber A) and after crimping the fiber was cut to a length of 38 mm. (Staple fiber B)

(3) To the polymer of Dope A 18% of 1,1,2-trichloro-1,2,2-trifluoroethane, 0.2% of titanium dioxide and 1.7% of polyglycidyl methacrylate were added and the final concentration of the polymer was adjusted to be 23.0 weight % and the dope was then stirred for 3 hours at 45° C. to be thoroughly dissolved. Then the dope so prepared was injected through a nozzle plate having 3,333 holes 0.08 mm 0.08 mm in width and 0.60 in length into the first bath of 20% aqueous solution of acetone 30° C. Then the fiber was drawn 1.2-fold in the second bath of the same temperature and concentration, and through the third rinsing bath 80° C., fourth rinsing bath 85° C. and the 5th rinsing bath 90° C. the fiber was further drawn 2.1-fold. Thereafter the fiber was finished in the same way as described above and after crimping the fiber was cut to a length of 51 mm. (Staple fiber C)

TABLE 1

| | Fiber Fineness (d) | Strength (g/d) | Elongation (%) | Young's modulus (kg/mm$^2$) | Crimp apexes (per 1") | Exp. ratio |
|---|---|---|---|---|---|---|
| S.F. A | 7.6 | 2.6 | 27 | 280 | 7.2 | 11 |
| S.F. B | 3.1 | 2.9 | 27 | 310 | 8.2 | 12 |
| S.F. C | 20.0 | 2.2 | 25 | 350 | 6.0 | 7 |

The foamed fiber of the present invention has good mechanical properties to be well acceptable practically.

What we claim is:

1. A foamed synthetic fiber prepared by the process comprising the steps of:

(1) admixing an organic solvent solution of a thermoplastic polymer with 3–100% by weight of a foaming agent based on the thermoplastic polymer, wherein said foaming agent is soluble in the organic solvent for the polymer or the organic solvent solution and scarcely soluble or insoluble in an aqueous coagulating bath for wet or semi-dry wet spinning and wherein said foaming agent is liquid under normal pressure and has a boiling point of not more than 120° C., (2) pressing out the resulting mixture of step (1), as a spinning dope through a spinning nozzle, into said aqueous coagulating bath, so as to form a synthetic fiber wherein said aqueous coagulating bath has a temperature of not higher than the boiling point of said foaming agent, (3) rinsing the resulting synthetic fiber of step (2), (4) foaming and drying the resulting synthetic fiber of step (3) at a temperature not lower than the boiling point of said foaming agent and not lower than 100° C. so as to form a foamed synthetic fiber, wherein said foamed synthetic fiber has an expansion ratio of 3% or more.

2. A foamed synthetic fiber as recited in claim 1 wherein said thermoplastic polymer is acrylonitrile polymer or copolymers thereof.

3. A foamed synthetic fiber as recited in claim 1 wherein the cross-section of the fiber consists of a sponge-like core portion comprising a multiplicity of bubbles with partitioning walls and a sheath portion whose construction is clearly distinguishable from said core portion, the polymer forming said sheath and said core portions is of the same composition and the area ratio of said core portion to the entire cross-section is 5–90 percent.

4. A foamed synthetic fiber as recited in claim 1 or 3 wherein there is a bubble formation (foamed structure) inside said fiber and said fiber is flat with a major/minor axis ratio of 2.0 or more.

5. A method of preparing a foamed synthetic fiber comprising the steps of:

(1) admixing an organic solvent solution of a thermoplastic polymer with 3–100% by weight of a foaming agent based on the thermoplastic polymer, wherein said foaming agent is soluble in the organic solvent for the polymer or the organic solvent solution and scarcely soluble or insoluble in an aqueous coagulating bath for wet or semi-dry wet spinning and wherein said foaming agent is liquid under normal pressure and has a boiling point of not more than 120° C., (2) pressing out the resulting mixture of step (1), as a spinning dope through a spinning nozzle, into said aqueous coagulating bath, so as to form a synthetic fiber wherein said aqueous coagulating bath has a temperature of not higher than the boiling point of said foaming agent, (3) rinsing the resulting synthetic fiber of step (2), (4) foaming and drying the resulting synthetic fiber of step (3) at a temperature not lower than the boiling point of said foaming agent and not lower than 100° C. so as to form a foamed synthetic fiber, wherein said foamed synthetic fiber has an expansion ratio of 3% or more.

6. A method of manufacturing a foamed synthetic fiber as recited in claim 5 wherein said thermoplastic polymer is an acrylonitrile polymer or copolymers thereof.

7. A method of manufacturing a foamed synthetic fiber as recited in claim 5 wherein the cross-section of said fiber consists of a sponge-like core portion comprising a multiplicity of bubbles with partitioning walls and a sheath portion whose composition is clearly distinguishable from said core portion, the polymer forming said sheath and said core portions is of the same composition and the area ratio of said core portion to the entire cross-section is 5–90 percent.

8. A method of manufacturing a foamed synthetic fiber as recited in claim 5 or 7 wherein there is a bubble formation (foamed structure) inside said fiber and said fiber is flat with a major/minor axis ratio of 2.0 or more.

* * * * *